US005655257A

United States Patent [19]

Chavez

[11] Patent Number: 5,655,257

[45] Date of Patent: Aug. 12, 1997

[54] HUMAN HEAD'S SCALP SCRUBBER, CLEANSER AND DRYER

[76] Inventor: Richard N. Chavez, 732 Alvarado Dr., SE., Albuquerque, N. Mex. 87108

[21] Appl. No.: 422,431

[22] Filed: Apr. 14, 1995

[51] Int. Cl.[6] ..... A47L 9/06

[52] U.S. Cl. ..... 15/396; 15/402; 15/236.01; 15/210.1

[58] Field of Search ..... 15/393, 395, 401, 15/402, 400, 396

[56] References Cited

U.S. PATENT DOCUMENTS

| | | | |
|---|---|---|---|
| 1,817,585 | 8/1931 | Samuel . | |
| 1,902,534 | 3/1933 | Wielatz | 15/395 |
| 2,198,339 | 4/1940 | Hamilton | 15/395 |
| 2,232,218 | 2/1941 | Doty . | |
| 2,250,878 | 7/1941 | Quaranti . | |
| 2,643,413 | 6/1953 | Buccasio | 15/396 |
| 2,800,678 | 7/1957 | Wessel | 15/395 X |
| 3,610,234 | 10/1971 | Oates . | |
| 3,965,527 | 6/1976 | George | 15/396 |
| 3,995,238 | 11/1976 | Remijas | 15/396 X |
| 4,071,021 | 1/1978 | Gallacci . | |
| 4,615,066 | 10/1986 | Colognori | 15/244.1 |
| 4,619,014 | 10/1986 | Piken | 15/244.1 |
| 4,694,529 | 9/1987 | Choiniere | 15/395 X |
| 4,715,088 | 12/1987 | Haase | 15/395 X |
| 4,793,331 | 12/1988 | Stewart . | |

FOREIGN PATENT DOCUMENTS

| | | | |
|---|---|---|---|
| 511102 | 3/1955 | Canada | 15/400 |

*Primary Examiner*—Chris K. Moore

*Attorney, Agent, or Firm*—DeWitt M. Morgan, Esq.; Kevin Lynn Wildenstein, Esq.

[57] ABSTRACT

A scalp scrubber for insertion between the scalp of a human head and an artificial hair piece attached to the scalp along at least a portion of the perimeter of the hair piece. The scrubber includes a handle portion having a free end and a scrubber head portion attached to the opposite end of the handle portion. The head portion, which is wide and flat, also includes a plurality of flexible teeth having rounded exposed tips. The teeth are no longer than approximately 3/16 of an inch, whereby the overall thickness of the scrubber head portion and teeth is no greater than ½ of an inch to permit easy insertion of the scrubber head portion between the human head's scalp and the hair piece without disturbing the attachment between the scalp and the hair piece. The handle and scrubber head portions may be provided with ducts to permit the passage of water during the scrubbing and cleansing process to clean the scalp and the hair piece, and warm air during the drying process to dry the scalp and the hair piece. Preferably, the head portion has, in cross-section, the approximate profile of a human skull and is thicker in the middle and tapered toward the edge, whereby the head portion may be used on the human head scalp in areas close to the attachment between the scalp and the hair piece without disturbing such attachment. Preferably, the teeth are spread approximately 3/16 of an inch apart.

11 Claims, 4 Drawing Sheets

A-A

HUMAN HEAD'S SCALP SCRUBBER, CLEANSER AND DRYER

BACKGROUND OF THE INVENTION

In bonded on or cabled hair replacement systems, sometimes referred to as "bonded/cabled" hair systems, a natural, semi-natural or artificial hair piece (hereinafter referred to as a "hair piece") is permanently secured over the bald area of a person's head by cable, sewing and/or gluing. This type of accessory is generally known in the industry as a "hair replacement unit," and is, typically, attached along the sides and back portions of the hair piece and the immediately adjacent portions of the wearer's head. Additionally, a piece of double faced tape is used to tack down the front (or, "vent") of the hair piece. This type of unit is sold and attached by, for instance Apollo Hair Systems, New Man Hair, HRS (Hair Replacement Systems) and HLH Hair Loss Correction, through local franchises throughout the United States.

With such a "permanent" attachment method, the hair piece can be worn confidently in virtually all circumstances, such as while swimming, in high winds, and other conditions that would be adverse to a non bonded/cabled on hair piece. Unfortunately, such bonded/cabled systems do not breath well and consequently, neither does the scalp underneath such a hair piece. The result is a buildup of bacteria and dead skin between the scalp and the hair piece. Unpleasant odors are also very evident. To address this problem, Apollo has suggested lifting the hair piece vent, where the unit is only taped on, and using a tooth brush to scrub the otherwise covered scalp. Apparently, Apollo franchises have regularly suggested this approach for at least 14 years. Unfortunately, because the hair piece is attached fairly tight, the use of a tooth brush for cleansing has very limited application. A toothbrush is too short, too thick, too awkward to use, can only be used on a limited portion of the covered scalp and has the potential of spreading bacteria because the bristles are closely spaced and firmly imbedded in bore holes which trap dirt. Additionally, the user runs the risk that, by using a tooth brush, a portion of the bonding or cabling will be torn, loosened or otherwise dislodged.

It is an object of the present invention to design a scalp scrubbing instrument which overcomes the drawbacks of a toothbrush, and which is easily utilized under substantially all replacement hair systems to effectively clean the covered scalp, to control bacteria, to remove dead skin and to otherwise improve scalp health and eliminate unpleasant odors. It is also an object of the present invention to decrease the risk of loosening or otherwise dislodging or disrupting the bonding/cabling mechanism.

SUMMARY OF THE INVENTION

A scalp scrubber for insertion between a human scalp and an artificial hair piece attached to the scalp along at least a portion of the perimeter of the hair piece. The scrubber includes a handle portion having a free end and a scrubber head portion attached to the opposite end of the handle portion. The scrubber head portion, which is wide and flat and has an edge portion in the form of a curved perimeter, also includes a plurality of flexible teeth having rounded exposed tips. The teeth are no longer than approximately 3/16 of an inch, whereby the overall thickness of the scrubber head portion and teeth is no greater than ½ of an inch to permit easy insertion of the scrubber head portion between the scalp and the hair piece without disturbing the attachment between the human head scalp and such hair piece.

Preferably, the scrubber head portion has, in cross-section, the approximate profile of a human skull and is thicker in the middle and tapered toward the edge, whereby the head portion may be used on the scalp in areas close to the attachment between the scalp and the hair piece without disturbing such attachment. The teeth are spread approximately 3/16 of an inch apart.

In one embodiment, the handle portion has a duct formed therein running from the free end to the scrubber head portion. The scrubber head portion includes a plurality of ducts connected to the handle portion duct, whereby fluid can pass from the free end to the scrubber head and onto said human head scalp and attached hair piece. In an alternate embodiment the scrubber head portion may be covered with a soft material, such as a terricloth, to dry the scalp after it has been cleansed.

In another embodiment, two separate structures can be securely coupled to each other to form the handle, or the handle can be formed from a single mold. Either prior to forming the handle or when the handle is formed, a flexible scrubbing means can be inserted into the handle's scrubber head portion. Due to the various pliable materials that can be used in forming the scrubbing means (such as silicone), the scrubbing means can also be removed and replaced from the scrubber head portion if desired. For example, the scrubber head can be replaced if the user desires more rigid teeth, or, the head can be replaced if it is worn. In this embodiment, the handle portion can have a duct formed therein. The head portion can include a plurality of ducts connected to the handle portion duct, whereby fluid or gas can pass through the handle to the scrubber head and onto said human head scalp and attached hair piece. Thus, the scalp scrubber can be used as a scrubber, a cleanser or as a dryer.

DESCRIPTION OF THE PREFERRED EMBODIMENT

Figure 1:
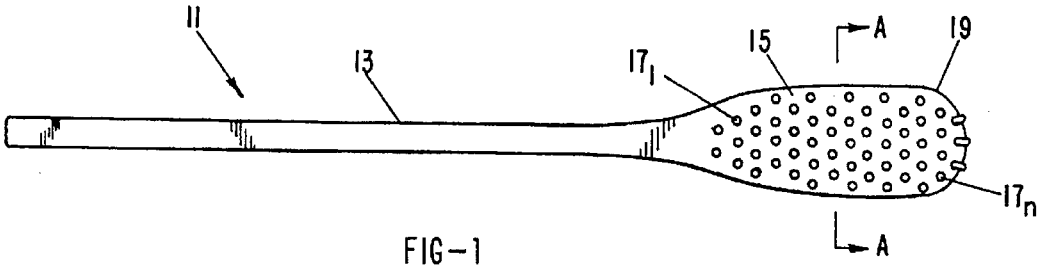
FIG. 1 is a top plan view of the scalp scrubber of the present invention.
Figure 2:
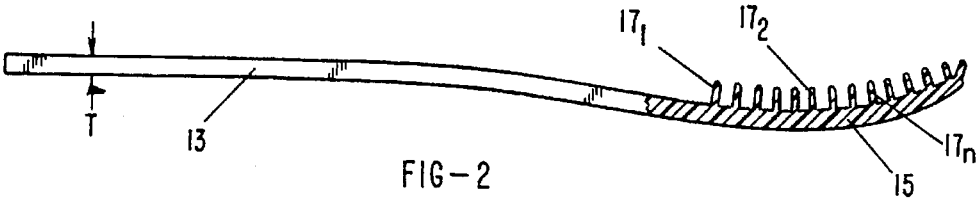
FIG. 2 is a side sectional view of the scalp scrubber of FIG. 1.

With reference to FIGS. 1 and 2, scalp scrubber 11 includes a handle portion 13, a head portion 15 and a plurality of flexible teeth $17_1$–$17_n$. Head portion 15 has, preferably, a rounded front (such as indicated at 19) and tapered edges (such as illustrated at 23, 25 in FIG. 3) to facilitate cleaning the scalp close to where the hair piece is attached to the wearer's existing hair and to minimize stretching or damaging the hair piece or the attachment interface with a sharp corner or edge. As illustrated in FIG. 2, head portion 15 and a portion of handle 13 are, preferably, curved to approximate the contour of the human skull. Additionally or alternately, handle may have an offset therein.

Figure 3:
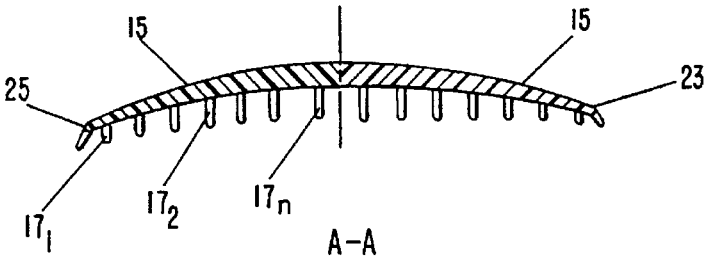
FIG. 3 is an enlarged sectional view of the scrubber of FIG. 1, taken along section A—A.

As will be appreciated, the dimensions of scalp scrubber 11, particularly the head portion 15, are somewhat critical to the invention in order to accommodate a human head's scalp. Preferably, the overall length of scrubber 11 is, approximately, 9½ of an inch. The width of head portion can range from 1 to 1½ of an inch; the length, at least 1½ of an inch. The preferred thickness, T, of both handle 13 and head 15, is ¼ to 5/16 of an inch. With the appropriate choice of material this could be reduced to 3/16 of an inch. Preferably, the flexible teeth are 3/16 of an inch long in the center, 1/16 inch wide, and have rounded tips, all as illustrated in FIG. 3. Also, preferably, the teeth 17 are spaced approximately 3/16 of an inch apart. Teeth $17_1$–$17_n$ are preferable over tooth brush style bristles because they do not have the same potential for spreading bacteria as toothbrush style bristles and because they are softer, smoother and more flexible. Teeth $17_1$–$17_n$ are also easy to clean.

Ideally, scalp scrubber 11 is molded as a one piece unit or a two piece unit, from, for instance, polyethylene, polypropylene, hard rubber or similar material.

Figure 4:
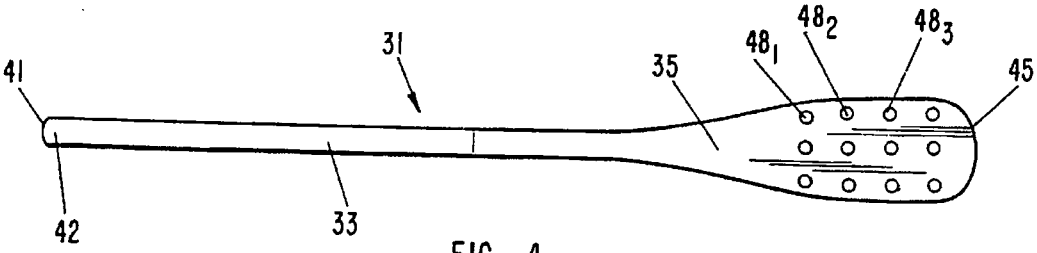
FIG. 4 is a plain view of an alternate embodiment of the invention.
Figure 5:
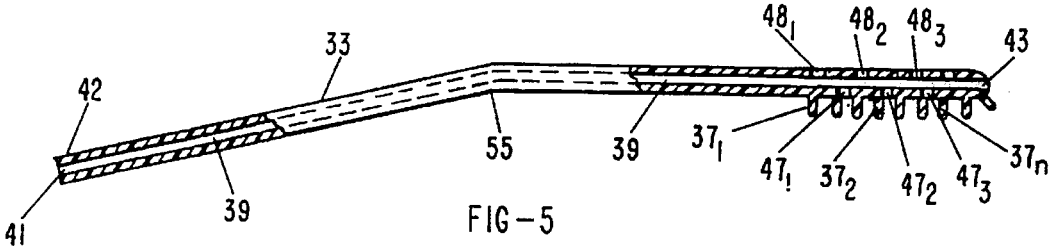
FIG. 5 is a partial, side cross-sectional view of the embodiment of FIG. 4.
Figure 6:
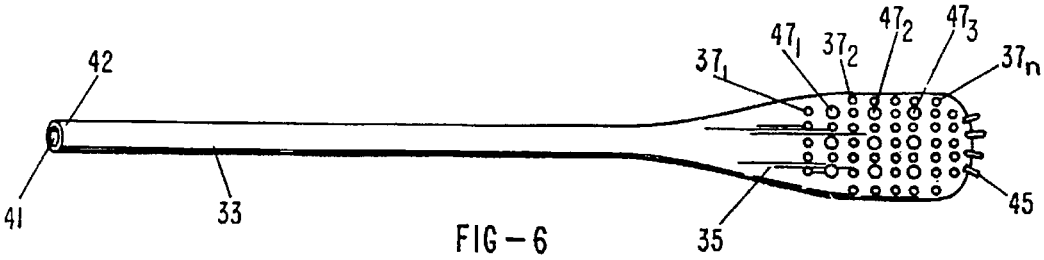
FIG. 6 is the opposite plain view of the scalp scrubber of FIG. 4.

With reference to the alternate embodiment as shown in FIGS. 4, 5 and 6, scrubber 31 includes a handle portion 33, a head portion 35 and flexible teeth $37_1$–$37_n$. As is evident from FIGS. 4 and 5, handle portion 33 has a continuous channel 39, extending from inlet 41 at end 42 to outlet 43 at scrubber head end 45. Coming off channel 39 are a first plurality of outlets, $47_1$, $47_2$, $47_3$ . . . $47_n$ on one side of the head portion, and a second plurality of outlets $48_1$, $48_2$, $48_3$, . . . $48_n$ on an opposite side of the head portion. Channel 39 and outlets 43 and $47_1$, $47_2$, $47_3$, . . . $47_n$ . . . permit the use of fluid under pressure to scrub and cleanse the human scalp. Outlets $48_1$, $48_2$, $48_3$ . . . $48_n$ permit the use of water under pressure to flush/rinse the underside of a hair piece mat. The inlet end 42 could be coupled, for example, to a source of water pressure in a manner such as those disclosed in U.S. Pat. No. 3,610,234, U.S. Pat. No. 4,793,331, U.S. Pat. No. 3,393,673 or similar pumping mechanisms.

As with the embodiment of FIGS. 1 and 2, scrubber 31 in FIG. 4 is made from polyethylene, polypropylene, hard rubber or similar material. Handle 33 and head 35 are approximately 5/16 of an inch thick, flexible teeth $37_1$–$37_n$ are approximately 3/16 of an inch long in the center with rounded ends (as illustrated in FIG. 3) and spaced on approximately 3/16 inch centers. Center channel 39 as well as outlets $47_1$, $47_2$, $47_3$ . . . and outlets $48_1$, $48_2$, $48_3$, . . . are ⅛ inch in diameter. For convenience, scrubber 31 can have an angled or arcuate bend at 55 to accommodate use on a human head's scalp. The cross-sectional profile of FIG. 4 is depicted in FIG. 5. Alternately, scrubber 31 could have the same shape and profile depicted in FIGS. 1 and 2 as scrubber 11.

Figure 7:
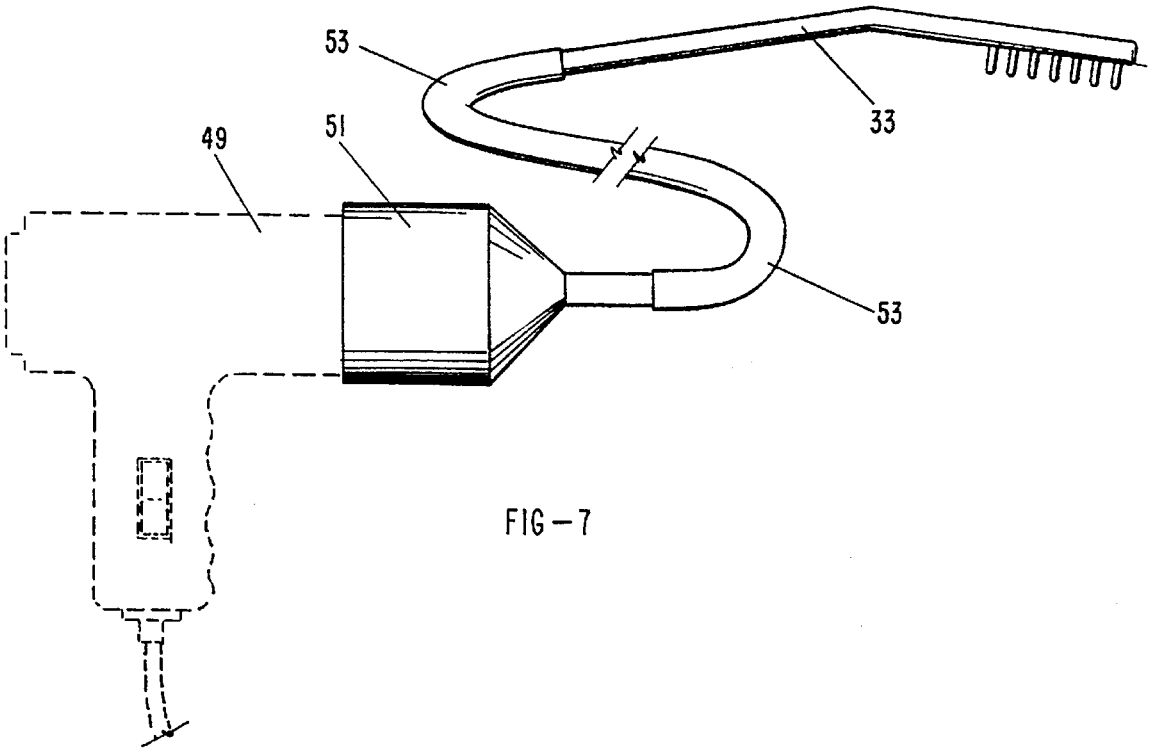
FIG. 7 illustrates the embodiment of FIG. 4 with a hair dryer and dryer attachment.

As illustrated in FIG. 7, after scrubbing and washing, inlet 41 could also be coupled to a source of cool or warm air from a suitable portable hair dryer 49, via adapter 51 and a flexible conduit 53, to dry both the scalp and the hair piece.

Figure 8:
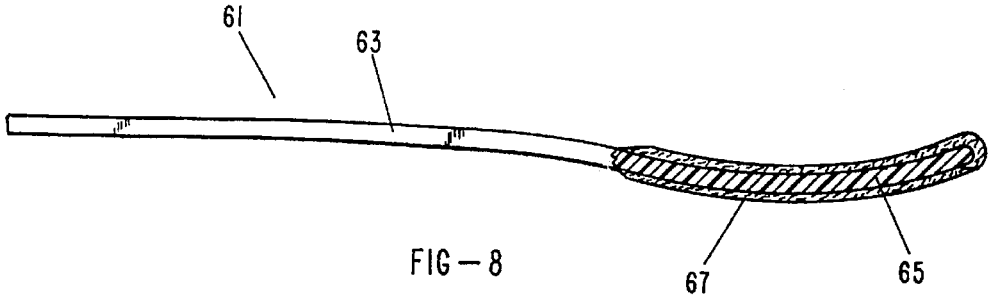
FIG. 8 illustrates a second alternate embodiment of the invention.
Figure 9:
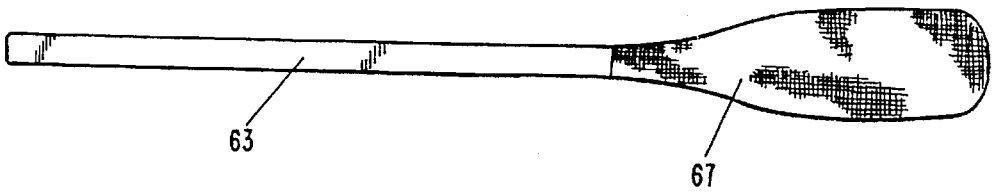
FIG. 9 is a plain view of the embodiment of FIG. 8.

With reference to FIGS. 8 and 9, scrubber/dryer 61 includes a handle portion 63 and a head portion 65. Scrubber 61 has the same general configuration and dimensions as scrubber 11. However, in place of teeth $17_1$–$17_n$, head portion 65 is covered with a soft, somewhat abrasive material or any similar material 67, which results in an overall thickness of approximately 7/16 of an inch. Scrubber 61 can be used for scrubbing, and could have water outlets in head portion 65, of the type illustrated in reference to FIGS. 4, 5, and 6. Additionally, by placing a dry soft material on head 65, scrubber 61 could be used for drying, either alone or in conjunction with warm air as depicted in FIG. 7.

Figure 14:
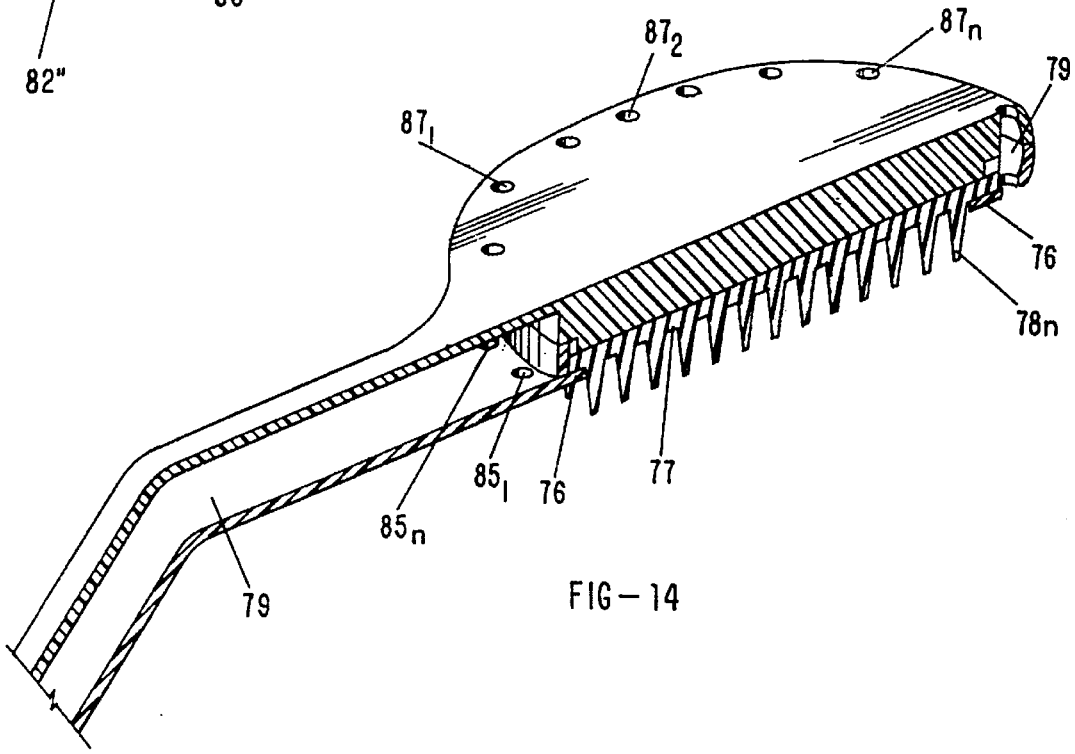
FIG. 14 is a partial, side cross-sectional perspective view of the embodiment in FIG. 10.

FIGS. 10–16 depict additional embodiments of the present invention. In these embodiments, scrubber 71 and 81 can also be used as a stand-alone scalp scrubber, or as a washer or dryer for both a human head's scalp and an attached hair piece. With regard to FIG. 10, scrubber 71 has a unitary handle 73 which a user can grasp, and a scrubber head 75. As seen generally in FIGS. 11 and 14, and cross-sectionally at FIG. 13, securely attached to scrubber head 75 is a removable scrubbing means 77. Scrubbing means 77 is defined by a plurality of flexible teeth $78_1$, $78_2$, $78_3$, . . . $78_n$ which are approximately 3/16 of an inch long with rounded tips. Scrubbing means 77 can be formed from a soft or hard compound, and thus is variably flexible. Scrubbing means 77 can be molded, for example, from rubber, soft silicone or like compounds. The softness or flexibility can be adjusted depending upon the polymer or plasticizer used. To prevent the build up of trapped dirt, teeth $78_1$, $78_2$, $78_3$, . . . $78_n$ can be spaced approximately 3/16 of an inch apart. As seen in FIG. 14, scrubbing means 77 is securely engaged with scrubber head 75 by lip portion 76. Naturally, because scrubbing means 77 is formed from a flexible material such as soft silicone, it can easily be removed from scrubber head 75 and also inserted into scrubber head 75. This allows a user to interchange or replace scrubber means 77 should the need arise.

Figure 10:
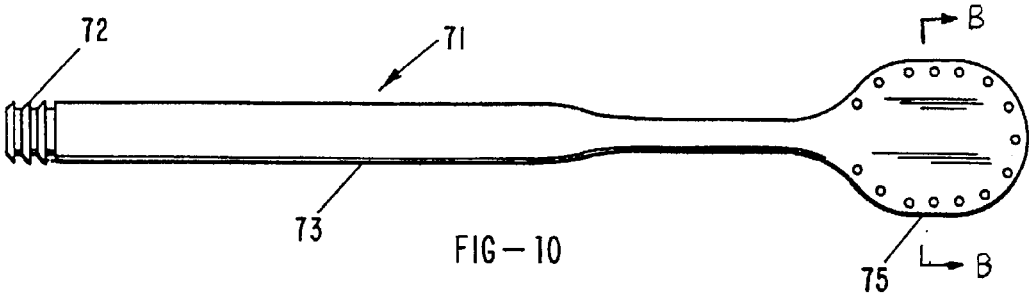
FIG. 10 depicts a top view of a third alternating embodiment of the invention.
Figure 11:
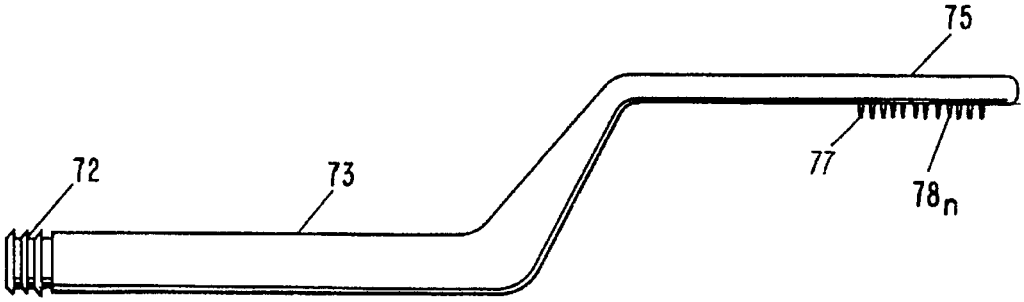
FIG. 11 is a side view of the embodiment in FIG. 10.
Figure 12:
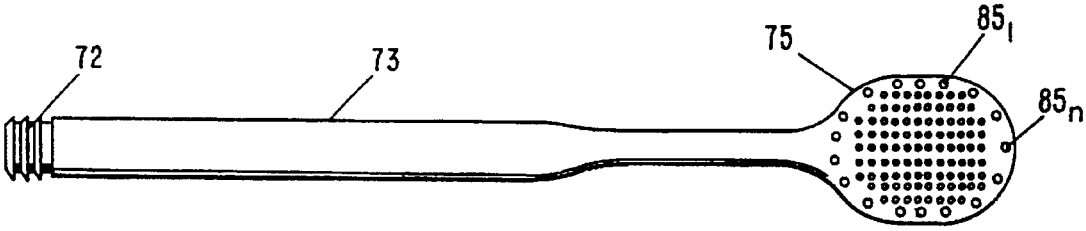
FIG. 12 is a bottom view of the embodiment in FIG. 10.
Figure 13:
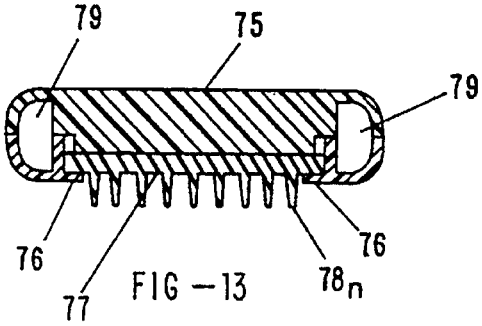
FIG. 13 is a partial, cross sectional view of the embodiment in FIG. 10, taken along B—B.
Figure 15:
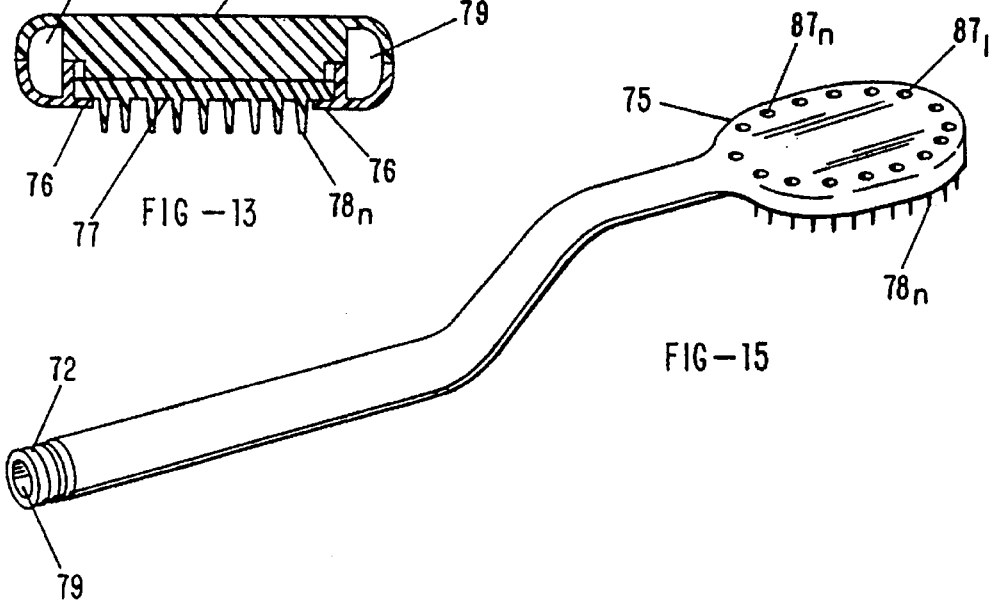
FIG. 15 is a rear perspective view of the embodiment in FIG. 10.

When used as a washer or as a dryer, scrubber 71 also includes an attachment means 72 formed on one end of handle 73. In this embodiment, as depicted in FIG. 14, scrubber 71 is formed with a continuous channel 79 extending through attachment means 72 to scrubber head 75. Scrubber head 75 is formed with a plurality of outlets $87_1$, $87_2$, $87_3$, . . . $87_n$ on one side, and a plurality of outlets $85_1$, $85_2$, $85_3$, . . . $85_n$ on an opposite side. Although outlets $87_1$, $87_2$, $87_3$, . . . $87_n$ and outlets $85_1$, $85_2$, $85_3$, . . . $85_n$ are not shown in FIG. 13, those skilled in the art will realize that the scrubber head can be formed with or without such outlets. As seen in FIG. 12, outlets $85_1$, $85_2$, $85_3$, . . . $85_n$ permit the passage of gas or fluid from scrubber head 75 to a human head's scalp. As FIGS. 10 and 15 show, outlets $87_1$, $87_2$, $87_3$, . . . $87_n$ permit the passage of gas or fluid from scrubber head 75 to the hair piece surrounding the human head's scalp. When fluid, such as soapy water, is applied through duct 79, scrubber 71 acts as a washer of the surrounding human scalp and attached hair piece. When gas, such as heated air, is applied through duct 79, scrubber 71 acts as a dryer of the surrounding human scalp and attached hair piece. Naturally, attachment means 72 is formed to engage any conventional hose, such as, for example, one having an internally threaded connection. Those skilled in the art can appreciated that attachment means 72 can incorporate a number of different hose attachment designs, and therefore, the teachings of this invention are not limited to a single design.

Figure 16:
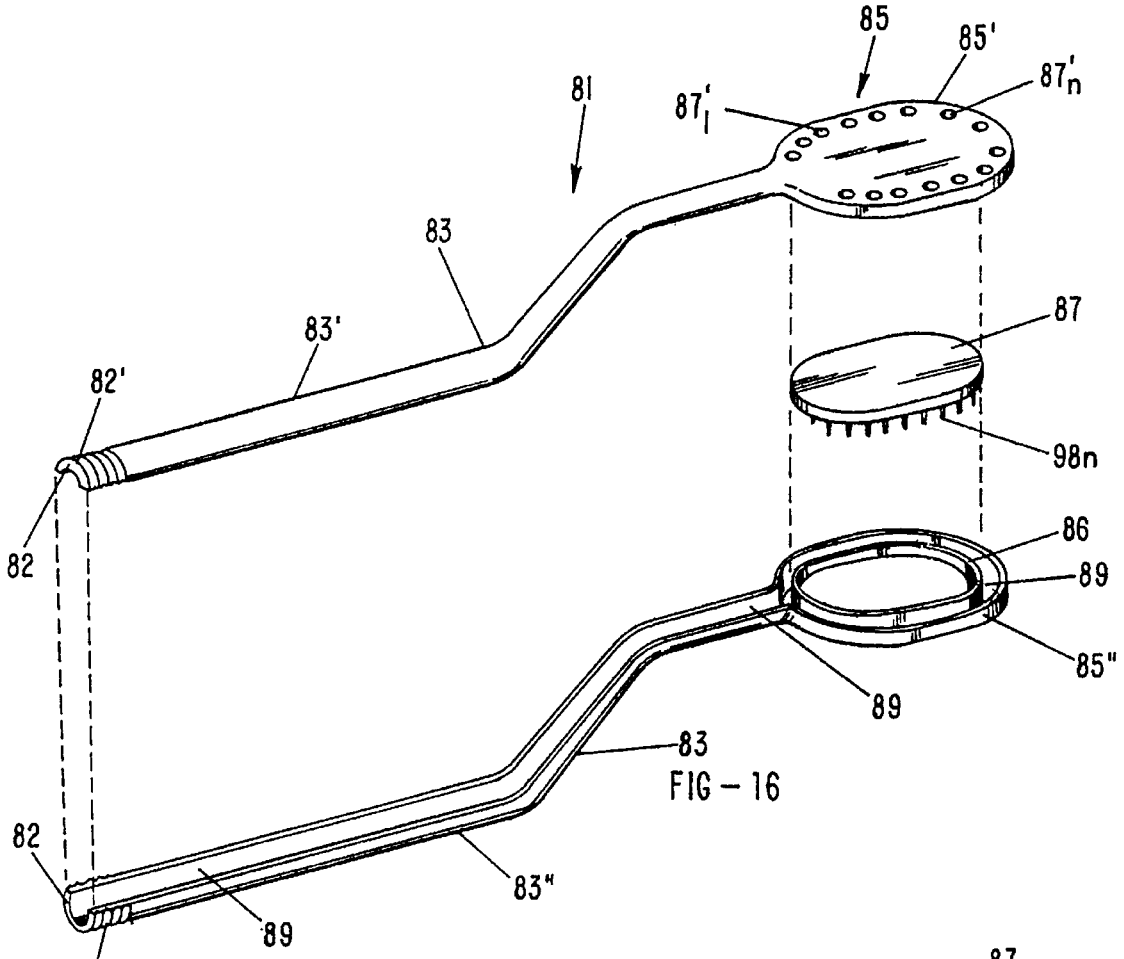
FIG. 16 is an exploded, side perspective view of the embodiment in FIG. 10.

FIG. 16 also depicts an alternate embodiment of the present invention. As shown, scrubber 81 has a handle (shown generally at 83) which can be formed from two separate structures. In this embodiment, sections 83' and 83" are securely coupled by any conventional method, such as solvent bonded or ultrasonically joined, to form handle 83. Scrubber head 85 is formed from a scrubber head top section 85' and a scrubber head bottom section 85". Prior to forming handle 83, a scrubbing means 87 can be inserted between scrubber head top section 85' and scrubber head bottom section 85". Similar to the embodiments described in FIGS. 10–15, scrubbing means 87 is defined by a plurality of flexible teeth $98_1, 98_2, 98_3, \ldots 98_n$ which are approximately 3/16 of an inch long with rounded tips. To prevent the build up of trapped dirt, teeth $98_1, 98_2, 98_3, \ldots 98_n$ can be spaced approximately 3/16 of an inch apart. Similar to the engagement between scrubber head 75 and scrubbing means 77 in FIG. 14, scrubbing means 87 is securely engaged within scrubber head 85 by an integrally formed lip portion 86 disposed on the scrubber head bottom section 85", and is further supported by scrubber head top section 85'.

Those skilled in the art can appreciate that this embodiment also can incorporate washer and dryer characteristics, similar to other embodiments disclosed in this invention. In this regard, scrubber 81 also includes an attachment means 82' and 82" formed on one end of handle 83, that when coupled together, form attachment means 82. Scrubber 81 is formed with a continuous channel 89 extending through attachment means 82 to scrubber head 85. Scrubber head top section 85' is formed with a plurality of outlets $87_1', 87_2', 87_3', \ldots 87_n'$ on one side, and a plurality of outlets $85_1', 85_2', 85_3', \ldots 85_n'$ on an opposite side (not shown in FIG. 16). Similar to the embodiment in FIG. 14, outlets $85_1', 85_2', 85_3', \ldots 85_n'$ permit the passage of gas or fluid from scrubber head 85 to a human scalp. Outlets $87_1', 87_2', 87_3', \ldots 87_n'$ permit the passage of gas or fluid from scrubber head 85 to the hair piece surrounding the human scalp. When fluid, such as soapy water, is applied through duct 89, scrubber 81 acts as a washer of the surrounding human scalp and attached hair piece. When gas, such as heated air, is applied through duct 89, scrubber 81 acts as a dryer of the surrounding human scalp and attached hair piece. Naturally, attachment means 82 is formed to engage any conventional hose, such as, for example, a hose having an internally threaded hose connection. Those skilled in the art can appreciated that attachment means 82 can incorporate a number of different hose attachment designs, and therefore, the teachings of this invention are not limited to a single design.

Whereas the drawings and accompanying description have shown and described the preferred embodiment of the present invention, it should be apparent to those skilled in the art that various changes may be made in the form of the invention without affecting the scope of this invention.

I claim:

1. A scalp scrubber for insertion between a human head's scalp and an artificial hair piece attached to said scalp along at least a portion of the perimeter of said hair piece, said scalp scrubber comprising:

a. an elongated non-compressible handle having a scrubber head at one end and a grasping portion at an opposite end, said scrubber head being flat and wide and having a top surface and a bottom surface; and b. a removable scrubbing means having a flat and wide surface smaller than said scrubber head, said flat and wide surface being smooth on one side and having an integrally formed scrubber surface on an opposite side, said scrubber surface forming a plurality of flexible teeth having rounded exposed tips, said teeth being no longer than approximately 3/16 of an inch, said circular scrubber head portion adapted to securely engage said removable scrubbing means, whereby the overall thickness of said scrubbing means and said scrubber head is no greater than ½ of an inch, thereby allowing easy insertion of said scrubber head between a bald portion of said scalp and said hair piece without disturbing said attachment between said scalp and said hair piece accessory.

2. The scalp scrubber of claim 1 wherein an attachment means is integrally attached to said grasping portion on said handle, said attachment means having a continuous channel formed therein extending through said attachment means said channel extending through to said grasping portion.

3. The scalp scrubber of claim 2 wherein a duct is formed within said handle, said duct extending from said attachment means to said scrubber head, said duct being in fluid communication with said attachment means channel to allow an external fluid to flow through said attachment means channel and through said duct.

4. The scalp scrubber of claim 3 wherein a plurality of openings are formed within and upon said scrubber head top and bottom surfaces, said plurality of openings in fluid communication with said duct of said handle.

5. The scalp scrubber of claim 4 wherein said plurality of openings are formed around a perimeter of said circular scrubber head.

6. The scalp scrubber of claim 5 wherein said handle is angled between said scrubber head and said grasping portion.

7. The scalp scrubber of claim 1 wherein said teeth are spread approximately 3/16 of an inch apart.

8. The scalp scrubber of claim 7 wherein said handle is formed from first and second non-compressible structures, each structure having a scrubber head at one end and a grasping portion at an opposite end, both scrubber heads being flat and wide, and capable of engaging said scrubbing means when said first structure is securely coupled to said second structure.

9. The scalp scrubber of claim 1 wherein said handle is formed from first and second non-compressible structures, each structure having a scrubber head at one end and a grasping portion at an opposite end, both scrubber heads being flat and wide, and capable of engaging said scrubbing means when said first structure is securely coupled to said second structure.

10. A scalp scrubber, washer and dryer for insertion between a human head's scalp and an artificial hair piece attached to said scalp along at least a portion of the perimeter of said hair piece, said scalp scrubber, washer and dryer comprising: a handle portion having a free end and a head portion attached to said handle portion opposite said free end, said handle portion and said head portion being formed of non-compressible material, the overall thickness of said head portion being no greater than ½ of an inch to permit easy insertion of said head portion between said scalp and said hair piece without disturbing said attachment between said scalp and said hair piece, said handle portion having a duct formed therein running from said free end to said head portion, said head portion adapted to securely receive a flexible scrubbing means, said head portion further including a plurality of outlets in fluid communication with said handle portion duct, whereby gas or fluid can pass from said free end to said head portion through said outlets and onto said scalp.

11. The scalp scrubber, washer and dryer of claim 10, wherein said free end, said handle portion and said head portion are formed from a first portion and a second portion, said first portion being coupled to said second portion to form a unitary free end, handle portion and head portion having a duct formed therein.

* * * * *